US006585553B1

(12) United States Patent
Fetridge et al.

(10) Patent No.: US 6,585,553 B1
(45) Date of Patent: Jul. 1, 2003

(54) TOY BUILDING SET

(75) Inventors: Keith Fetridge, Granby, CT (US); Bryant Pierre, Carrollton, TX (US); Peter Smith, West Ryde (AU)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/889,070

(22) PCT Filed: Jan. 11, 2000

(86) PCT No.: PCT/DK00/00007

§ 371 (c)(1),
(2), (4) Date: Jan. 3, 2002

(87) PCT Pub. No.: WO00/41790

PCT Pub. Date: Jul. 20, 2000

(30) Foreign Application Priority Data

Jan. 11, 1999 (DK) ..... 1999 00022

(51) Int. Cl.[7] ..... A63H 33/04

(52) U.S. Cl. ..... 446/91; 446/484; 446/90; 446/128; 446/125; 446/124

(58) Field of Search ..... 446/128, 125, 446/124, 118, 91, 90; 439/650, 651, 652; 320/127, 128, 135, 101, 166

(56) References Cited

U.S. PATENT DOCUMENTS

| | | | | | |
|---|---|---|---|---|---|
| 3,696,548 | A | * | 10/1972 | Teller | 446/91 |
| 4,109,398 | A | * | 8/1978 | Hida | 446/94 |
| 4,697,133 | A | * | 9/1987 | Pergandis | 446/484 |
| 4,861,306 | A | * | 8/1989 | Bolli et al. | 446/90 |
| 5,154,615 | A | * | 10/1992 | Joubert | 446/90 |

FOREIGN PATENT DOCUMENTS

| | | | | |
|---|---|---|---|---|
| EP | 792669 A1 | * | 9/1997 | A63H/33/26 |

* cited by examiner

*Primary Examiner*—Derris H. Banks
*Assistant Examiner*—Urszula M Cegielnik
(74) *Attorney, Agent, or Firm*—Pitney, Hardin, Kipp & Szuch LLP

(57) ABSTRACT

A toy building set with interconnectible building elements and comprising an energy source, an energy accumulator and a consumer of energy as separate units which may be built together with the building elements, wherein the energy accumulator may be coupled to the energy source so that energy from the energy source is transferred to and accumulated to the energy accumulator, and the energy accumulator may be coupled to the consumer to supply energy accumulated in the energy accumulator to the consumer.

10 Claims, 1 Drawing Sheet

TOY BUILDING SET

The invention relates to a toy building set of toy building elements and comprising an energy source, an energy accumulator and a consumer of energy as separate units which may be built together with the building elements, wherein the energy accumulator may be coupled to the energy source so that energy from the energy source is transferred to and is accumulated in the energy accumulator, and the energy accumulator may be coupled to the consumer to supply energy accumulated in the energy accumulator to the consumer. The consumer may be a consumer proper where the energy is converted into useful effect for the user, or the consumer may be an indicator, which directly or indirectly shows how much energy is accumulated in the energy accumulator.

Systems are known in which the energy accumulator is rechargeable electrochemical batteries which may be placed in a charging station for charging and for later recharging, following which the charged batteries are removed from the charging station and are moved to a consumer in the form of an electrical apparatus which is to be supplied with electrical energy from the batteries. The rechargeable batteries are typically of the NiCd or NiMH type, and recharging takes a relatively long time, typically one or several hours. Moreover, charging and recharging involve a considerable loss of energy.

Electrical systems are known in which a permanently incorporated electrical capacitor serves as an accumulator of electrical energy. EP 792 669 shows an electrical system with a movable electrical capacitor which can transport electrical energy from an electrical energy source to a consumer. DE 819 556 shows an electrical lamp with a built-in spring-driven electrical generator. DE 29 806 440 U1 describes an electrical lamp with a hand-driven electrical generator and a rechargeable battery or electrical capacitor as an energy accumulator. GB 2 002 643 shows a toy building set in which some building blocks have a built-in solar energy cell.

Known are also mechanical systems e.g. in the form of toy cars where mechanical energy is accumulated as potential energy in a spring which is tensioned, or as kinetic energy in a flywheel. Examples of this are found in DK 112 075, U.S. Pat. No. 4,595,381, DE 2 906 064 and U.S. Pat. No. 4,430,818.

A system according to the invention provides new educational and instructive possibilities enabling a user to check and compare the energy content of various energy sources and their usefulness, as well as the possibility of checking the energy consumption of various energy-consuming units. The user's awareness of environment and energy can be developed, and at the same time the user obtains basic insight into the technique concerning energy and conversion of energy.

The invention will be explained below with reference to the drawings, in which

Figure 1:
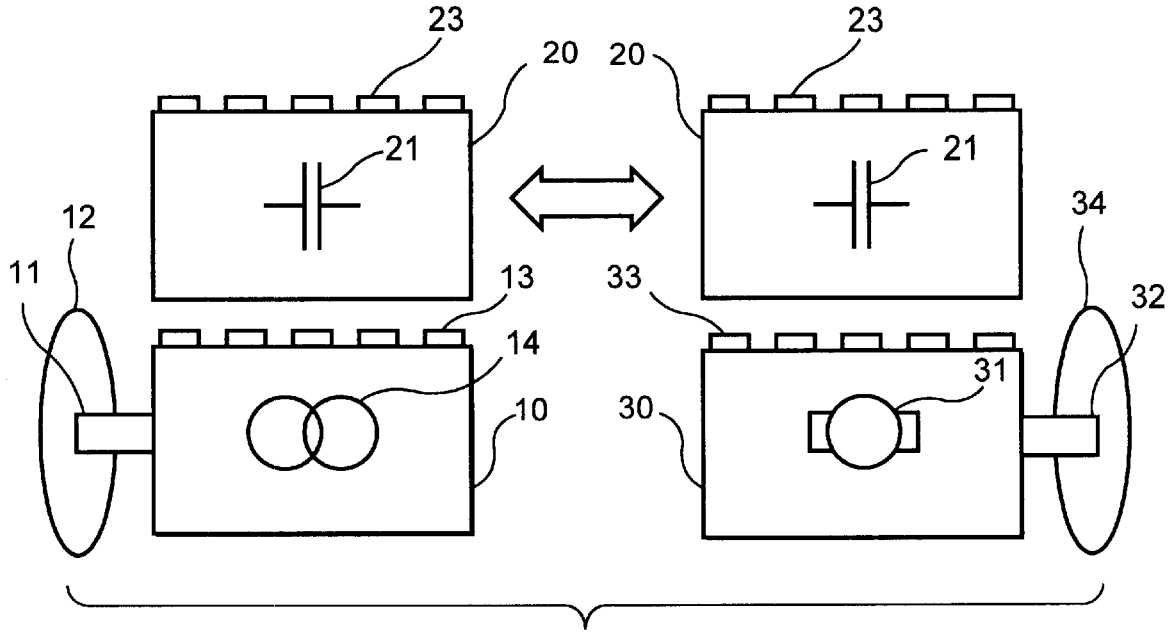
Figure 2:
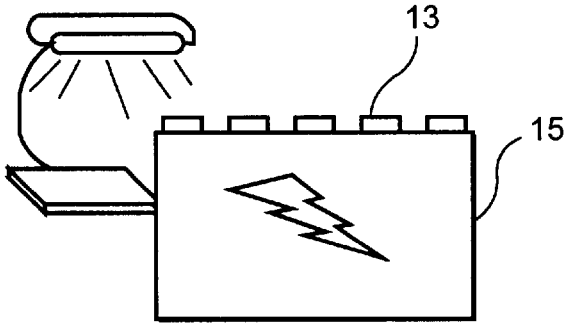
Figure 3:
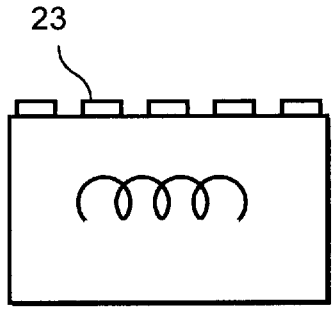
Figure 4:
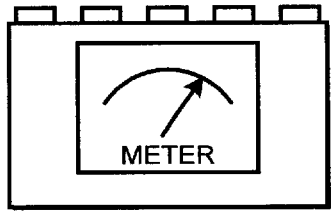

FIG. 1 schematically shows a system according to the invention,

FIG. 2 schematically shows an energy source with solar energy cells,

FIG. 3 shows an energy accumulator for the storage of mechanical energy, and FIG. 4 shows an energy meter.

FIG. 1 shows an energy source 10 which is here a rectangular box with a built-in electromechanical generator 14 having a rotatable input shaft 11 on which a wheel 12 is mounted. The wheel 12 is shown schematically here and may have a crank for manual operation of the generator. In an alternative embodiment the wheel 12 is a wing wheel for operating the generator by means of wind power or water power, where the wing wheel will rotate the shaft 11 of the generator, whereby the generator converts the mechanical rotary energy into electrical energy.

FIG. 2 shows an alternative embodiment in which an energy source 15 has a panel of solar energy cells for converting light or other electromagnetic energy into electrical energy.

The energy sources 10 and 15 have a plurality of cylindrical coupling studs 13 of a known type on the upper side, and the bottom has a cavity (not shown) to receive coupling studs on other elements in a frictional engagement in a known manner. The coupling studs 13 are of the type which is known e.g. from toy building sets marketed under the trade mark LEGO TECHNIC, and which has electrically conducting metal parts on selected parts of their cylindrical surface. The built-in generator 14 of the energy source 10 is connected with these metal parts, which thus serve as output terminals for the generator 14 and thereby for the energy source 10. Correspondingly, the solar cells in the energy source 15 are connected with its output terminals. Of course, other types of coupling means may be used for building the building elements together, numerous such coupling means being known, and the invention is thus not restricted to use in the shown toy building sets.

FIG. 1 also shows an energy accumulator 20 which is here a rectangular box with a built-in electrical capacitor 21. On its upper side, the energy accumulator 20 has a plurality of coupling studs 23 of the same type as the coupling studs 13 on the energy source 10. The energy accumulator 20 has a cavity (not shown) on its lower side, capable of receiving the coupling studs 13 on the energy source 10 in a known manner. The sides of the cavity have metal parts at selected places likewise in a known manner, and the electrical capacitor has its terminals connected to these metal parts, which thus serve as terminals for the energy accumulator. The terminals of the capacitor may also be connected to the coupling studs 23 on the upper side.

When the energy accumulator 20 is thus built on the energy source 10 in a known manner, the output terminals of the generator 14 on the coupling studs 13 will be in electrical contact with the terminals of the capacitor 21 in the cavity of the energy accumulator 20.

Rotation of the shaft 11 of the generator will cause the generator 14 to produce an electrical voltage, typically a DC voltage, which will be transferred to the capacitor 21 in the energy accumulator 20, whereby the generated electrical energy from the generator will be accumulated in the capacitor 21. The accumulated amount of energy depends on the energy source which drives the wheel 12 on the shaft 11 of the generator, and moreover on the period of time during which energy is transferred from the energy source 10 to the accumulator 20.

Correspondingly, the energy source 15 with solar energy cells may be connected with the energy accumulator 20 and charge the capacitor 21.

FIG. 1 also shows an energy consumer 30 which is here a rectangular box with a built-in electric motor 31. On its upper side, the energy consumer 30 has a plurality of coupling studs 33 of the same type as the coupling studs 13 and 23 on the energy source 10 and on the energy accumulator 20, respectively. In a manner corresponding to the generator 14, the motor 31 of the consumer has its electrical terminals connected to the metal parts on the coupling studs 33, which thus serve as input terminals for the motor 31 and thereby for the consumer 30.

The energy accumulator 20 may also be coupled on top of the consumer 30 in the same manner as described above and as indicated in the figure, whereby the capacitor 21 in the accumulator is connected electrically to the motor 31 in the consumer 30.

The system of FIG. 1 described above operates as follows. The energy accumulator 20 is first coupled on the energy source 10. The wheel 12 of the generator is rotated manually or, as mentioned, by means of wind power or water power or in another manner, whereby the generator generates a certain amount of electrical energy which is transferred to the capacitor 21 in the accumulator 20. After a period of time selected by the user, the accumulator 20 is disconnected from the energy source 10 and is coupled together with the consumer 30. Then the energy accumulated in the capacitor is supplied to the motor 31 in the consumer 30, whereby the motor will rotate, and a shaft 32 on the motor, which carries a wheel 34, will likewise rotate.

The consumer 30 may be an electrically driven toy car or another larger mechanism, or an electrical lamp which is caused to emit light.

FIG. 3 shows another embodiment where the energy accumulator is a mechanical spring which is tensioned by means of a mechanism in connection with the energy source and thereby receives potential energy. The spring may be a helical spring or a screw spring of spring steel or an elastic rubber band. The spring may maintain its tensioned state with suitable, known measures, while it is moved to the consumer where the energy may be used for driving a mechanism or an electrical generator. The mechanical energy accumulator may e.g. be a clockwork or a wind-up motor.

In yet another embodiment (not shown), the energy accumulator contains a mass in the form of a weight which is raised by the energy from the generator against the gravitational force and thereby receives and stores potential energy. When the accumulator is moved to the consumer, the accumulated potential energy can be released to the consumer which, here too, is mechanical.

In a third embodiment, the mechanical energy accumulator contains a flywheel which is caused to rotate, whereby the flywheel accumulates mechanical energy in the form of kinetic energy.

Mechanical energy accumulators may be charged with energy by being connected with a mechanical energy source. To this end, both the source and the accumulator have suitable means, such as the shown coupling studs and corresponding cavities for the mechanical interconnection, and moreover means for ensuring the transfer of mechanical energy, e.g. by means of gear wheels or a frictional or claw coupling. In a simple form, the mechanical energy source may be a key or a handle which may be coupled to the energy accumulator and be operated manually.

As shown in FIG. 4, the consumer may be an indicator which shows the amount of energy that is stored in the accumulator. In case of electrical energy, the indicator will typically be a voltmeter or another display instrument without a significant own consumption—optionally together with an energy consumer proper, which makes it possible to follow the temporal course of the energy consumption.

In case of mechanical energy, an energy meter may be constructed as a known dynamometer which shows the force with which the spring is tensioned. The dynamometer may optionally be built together with the spring.

With the system shown here the user can compare various energy sources in a simple and instructive way, and the user can get a good understanding of the concept energy, the generation of energy and its consumption.

A system in which the energy source is one or more solar energy cells allows comparison of the energy in sun light and comparison with the energy in the light from an electrical lamp or another energy source. With a windmill wheel, the energy in natural wind may be compared with the energy in the wind from an electrical blower, and two different electrical blowers may be compared.

What is claimed is:

1. A toy building set with interconnectible building elements, said building set moreover comprising an energy source;

an energy accumulator for accumulating energy, and a consumer of energy, wherein the energy source, the energy accumulator and the consumer are separate and separable units adapted to be built together with the building elements of the building set, and wherein the energy accumulator allows coupling to the energy source so that energy from the energy source is transferred to and accumulated in the energy accumulator, and the energy accumulator is releasable from the energy source to allow coupling to the consumer of energy in order to supply energy accumulated in the energy accumulator to the consumer of energy.

2. A toy building set according to claim 1, wherein the energy source is a source of electrical energy, wherein the energy accumulator comprises an electrical capacitor which accumulates the energy as electrical energy, and wherein the consumer is a consumer of electrical energy.

3. A toy building set according to claim 2, wherein the energy source comprises an electromechanical generator for converting mechanical energy into electrical energy.

4. A toy building set according to claim 3, wherein the generator comprises a crank for manual operation of the generator.

5. A toy building set according to claim 3, wherein the generator comprises a flywheel for operation of the generator by means of wind power.

6. A toy building set according to claim 3, wherein the generator comprises a flywheel for operation of the generator by means of water power.

7. A toy building set according to claim 2, wherein the energy source comprises a device for converting electromagnetic energy into electrical energy.

8. A toy building set according to claim 1, wherein the energy source is a source of mechanical energy, wherein the energy accumulator accumulates the energy as mechanical energy, and wherein the consumer is a consumer of mechanical energy.

9. A toy building set according to claim 8, wherein the energy accumulator comprises a spring which tensions to accumulate the mechanical energy.

10. A toy building set according to claim 8, wherein the energy accumulator comprises a mass which raises against a gravitational force to accumulate the mechanical energy.

* * * * *